US006431925B1

(12) United States Patent
Ito et al.

(10) Patent No.: US 6,431,925 B1
(45) Date of Patent: Aug. 13, 2002

(54) JET PROPULSION SYSTEM FOR WATERCRAFT

(75) Inventors: Kazumasa Ito; Tetsuya Ishino, both of Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/630,668

(22) Filed: Aug. 2, 2000

(30) Foreign Application Priority Data

Aug. 4, 1999 (JP) ..... 11-221666

(51) Int. Cl.[7] ..... B63H 11/00
(52) U.S. Cl. ..... 440/38; 440/47; 440/89
(58) Field of Search ..... 440/38, 47, 88, 440/89

(56) References Cited

U.S. PATENT DOCUMENTS

| | | | | | |
|---|---|---|---|---|---|
| 3,249,083 | A | * | 5/1966 | Irgens | 440/47 |
| 5,140,926 | A | * | 8/1992 | Denston | 440/38 |
| 5,234,364 | A | * | 8/1993 | Ito | 114/55.5 |
| 5,330,374 | A | * | 7/1994 | Ishino | 440/38 |
| 5,391,064 | A | * | 2/1995 | Lopez | 417/423.14 |
| 5,550,337 | A | * | 8/1996 | Tazaki et al. | 440/89 |

* cited by examiner

*Primary Examiner*—Stephen Avila
(74) *Attorney, Agent, or Firm*—Ernest A. Beutler

(57) ABSTRACT

A jet propelled watercraft having an improved extension assembly for dampening pulsations from the impeller of the jet propulsion unit and also an improved exhaust system having a separate idle discharge for permitting lower idle speeds without restriction of the idle exhaust gas flow.

16 Claims, 4 Drawing Sheets

JET PROPULSION SYSTEM FOR WATERCRAFT

BACKGROUND OF THE INVENTION

This invention relates to a jet propulsion system for a watercraft and more particularly to an improved device for minimizing the sound generated by the jet propulsion unit and also improving the performance of the engine and permitting lower idle speeds without inhibiting the operation of the engine.

Jet propulsion units are quite popular in connection with the propulsion of watercraft and especially a particular type of watercraft referred to as a "personal watercraft". These types of watercraft generally are designed to be operated by a rider who may carry no more than one to three additional passengers. Frequently these passengers are seated in straddle, tandem fashion on a longitudinally extending seat that is formed at the rear of the watercraft with the propulsion unit being disposed beneath the seat.

One problem particular with this type of construction can be best understood by reference to FIG. 1, which shows a prior art type of jet propulsion unit commonly utilized in these types of watercraft. The watercraft has a hull portion, indicated by the reference numeral 11 that defines a tunnel in which the jet propulsion unit outer housing, indicated generally by the reference numeral 12, is positioned. In this particular construction, the jet propulsion unit outer housing 12 is disposed above a ride plate 13 that may be affixed to the underside of the hull portion 11 in a suitable manner.

The jet propulsion unit outer housing 12 defines an impeller portion 14 that is disposed forwardly adjacent a bulkhead 15 that separates a tunnel area 16 in which the jet propulsion unit outer housing 12 is positioned from the engine compartment of the watercraft and which is positioned beneath its seat.

An impeller 17 is rotatably journalled in the impeller housing 14 and draws water through a water inlet passage 18. The water inlet passage 18 may be formed in any of a variety of manners and includes a downwardly facing inlet opening 19 through which water is drawn by the impeller 17.

The impeller 17 has affixed to it an impeller shaft 21, which extends forwardly through the bulkhead 15 and into the engine compartment for coupling to the powering prime mover in any known or suitable manner known in the prior art.

The pumped water is then discharged through a steering nozzle 22 that cooperates with a discharge nozzle 23 of the outer housing assembly 12. The steering nozzle 22 is pivotally supported for steering movement relative to the discharge nozzle 23 about a vertically extending axis by a pivot pin 24. By changing the direction of the steering nozzle 22, the associated watercraft is steered in a manner well known in this art.

In addition, a reverse thrust bucket 25 may be mounted at the discharge end of the steering nozzle 22 and in its illustrated position redirects the water flow forwardly so as to cause reverse operation of the associated watercraft. The reverse thrust bucket 25 is supported on the steering nozzle 22 by a further pivot pin 26 and is operated by a bucket control 27 so as to permit forward motion by pivoting the reverse thrust bucket 25 upwardly so that the water discharged from the steering nozzle 22 can go rearwardly.

As may be seen, the water inlet passage 18 curves upwardly from the inlet opening 19 and directly registered with the impeller housing 14 in close proximity to the impeller 17. It has been found that this causes pulsations in the water that is transmitted back through the forward wall of the bulkhead 15 and can create unpleasant vibrations in the watercraft and sounds that are undesirable.

It is, therefore, a first principal feature of this invention to provide an improved and low cost jet propulsion unit for a personal watercraft that avoids these pulsations.

It is a further object of this invention to provide an arrangement for utilizing this feature in conjunction with conventional type jet pumps so as to not require a redesign in either the hull or the jet pump in order to use the feature of the invention.

Another problem with this type of personal watercraft is the effect of noise and vibrations in the exhaust system. Generally, these types of watercraft employ a water trap device which is interposed in the exhaust system and which is designed so as to permit the cooling water from the engine to be mixed with the exhaust gases and provide silencing while reducing the likelihood that water can flow to the engine combustion chambers through the exhaust system.

As a result, these water trap devices are generally positioned rearwardly from the engine and constantly operate with a level of water within them. The exhaust gases must overcome the pressure of this head of water in order to exit the watercraft and this can cause excessive back pressure at idle. Thus, it is a common practice to utilize an accelerated idle speed to prevent stalling or uneven operation.

It is, therefore, a further object to this invention to provide an improved exhaust system for a watercraft that incorporates a water trap and wherein the idle exhaust gases can be discharged independently of the backpressure of water in the water trap.

SUMMARY OF THE INVENTION

A first feature of this invention is adapted to be embodied in a jet propulsion system for a watercraft that includes an outer housing having an impeller portion in which an impeller is rotatably journalled and a discharge nozzle portion rearwardly of it though which the water pumped by the impeller is discharged for propelling the associated watercraft. A water inlet assembly is provided that has a downwardly facing water inlet opening through which water may be drawn and curved discharged path that curves upwardly toward the axis of rotation of the impeller. A silencing portion is interposed between the water inlet portion and the impeller housing portion and has a shape that constitutes generally an extension of the opening of the inlet to the impeller housing so as to isolate the pulsations generated by the impeller from the water inlet portion.

In accordance with another feature of this invention, the extension portion can be formed at least in part from an elastomeric material to provide additional damping characteristics.

A propulsion system for a watercraft embodying another principal feature of the invention includes an internal combustion engine that powers a propulsion device and which has an exhaust system that includes a water trap device. The exhaust system further includes an exhaust conduit that conveys exhaust gases from the engine as an inlet to the water trap device. The water trap device communicates with an exhaust discharge for discharging the exhaust gases from the water trap device. At least one of the inlet or discharge portions of the water trap device is designed so as to be at least partially submerged in cooling water that is discharged into the engine exhaust system. This submersions exist under at least some running conditions of the watercraft. The exhaust system further includes a restricted exhaust discharge conduit that extends from the exhaust system upstream of the water trap device and discharges directly to the atmosphere independently of the water trap device.

DETAILED DESCRIPTION OF THE PREFERRED EMBODIMENTS OF THE INVENTION

Figure 2:
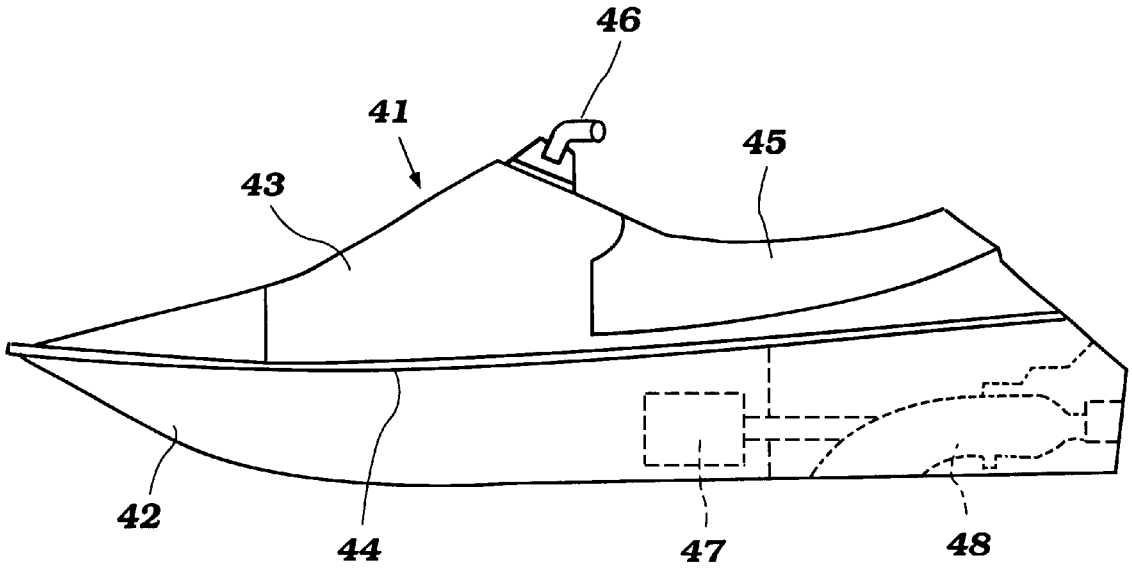
FIG. 2 is a side elevational view of a personal watercraft constructed in accordance with an embodiment of the invention.

Referring in detail first to FIG. 2, a personal watercraft constructed in accordance with an embodiment of the invention is shown and identified generally by the reference numeral 41. It is to be understood that, although the invention is described in conjunction with a personal watercraft, certain of the features herein disclosed may be utilized with other types of watercraft. However, the invention has particular utility in conjunction with personal watercraft due to their small size, compact nature and due to the increased demand for providing quieter operating watercraft of this type.

The watercraft 41 is comprised of a hull that consists primarily of a hull under portion 42 and deck portion 43 that are connected to each other along their peripheral edges by a gunnel 44. The deck portion 43 forms a longitudinally extending portion on which a straddle type seat 45 on which the rider/operator and two or three additional passengers may be seated. The seating is in straddle tandem position and the operator and his passengers place their feet in foot wells disposed on opposites sides of the seat 45.

A control handlebar 46 is positioned forwardly of the seat 45 for operation by the rider/operator so as to steer the watercraft, control it speed and other functions.

An internal combustion engine, shown schematically at 47 is contained in an engine compartment that is formed within the hull under portion 42 and which may be accessible through removal of the seat 45 and exposure of an access opening formed in the raised part of the deck portion 43. This engine 47 drives a jet propulsion unit, indicated generally by the reference numeral 48, positioned in a tunnel at the rear of the hull under portion 42 in a manner, which will be described now in connection with reference to FIGS. 3 through 6.

Figure 1:
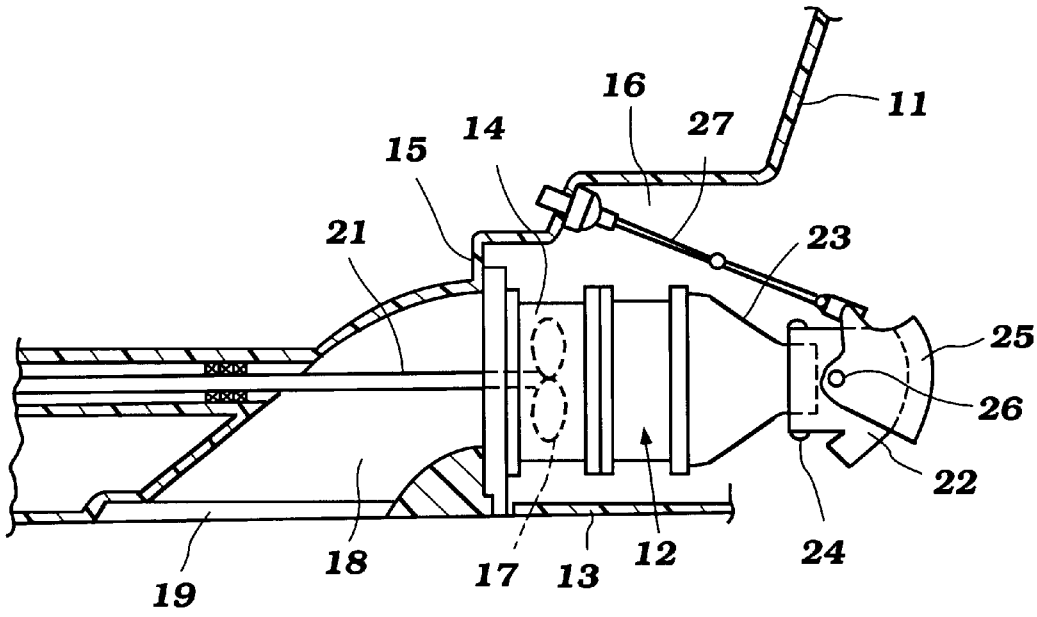
Figure 1 Prior Art
FIG. 1 is a broken away view taken through a personal watercraft powered by a conventional prior art type of jet propulsion system.

Referring now primarily to these figures, the jet propulsion unit 48 includes those components of the prior art type of jet propulsion units as shown in FIG. 1 and where the same conventional components are employed, they are identified by the same reference numerals as employed in FIG. 1. Again, the hull underside 42 has a tunnel portion 11 that defines a tunnel 16 in which the conventional jet propulsion unit housing assembly 12 is mounted. This unit includes the impeller housing portion 14 that contains the impeller 17, the discharge nozzle portion 23, the steering nozzle 22 and the reverse thrust bucket 25. In this figure, the reverse thrust bucket 25 is shown in its opened or forward drive condition.

In this embodiment, the impeller housing section 14 is disposed rearwardly from the bulkhead 15 so as to accommodate a silencing or extension assembly, indicated generally by the reference numeral 49. This silencing assembly 49 will be described in more detail later by reference to FIGS. 4 and 5. It is this silencing extension 49 that is utilized to secure the jet propulsion unit housing 12 to the bulkhead 15.

Figure 6:
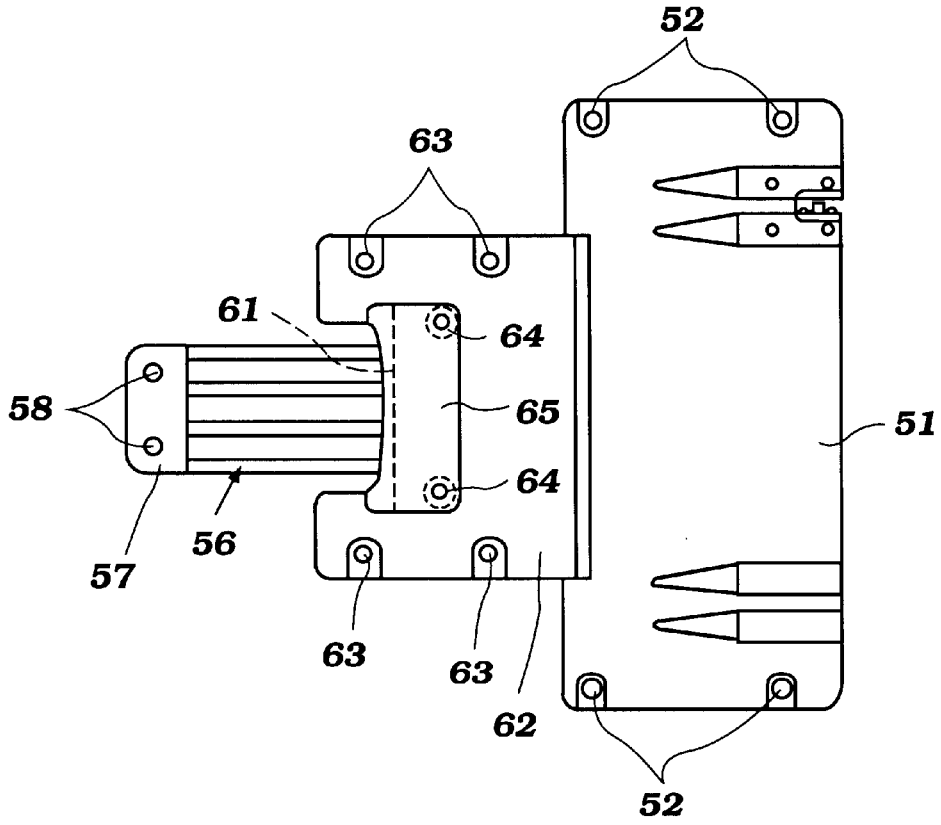
FIG. 6 is a bottom plan view of the components shown in FIG. 3 and which comprise generally the underlying units of the jet propulsion system.

In this assembly, the ride plate is indicated generally by the reference numeral 51 and as seen in FIG. 6, it is comprised of flanges that receive threaded fasteners 52 for affixing it suitably to the underside of the hull portion 42.

Figure 3:
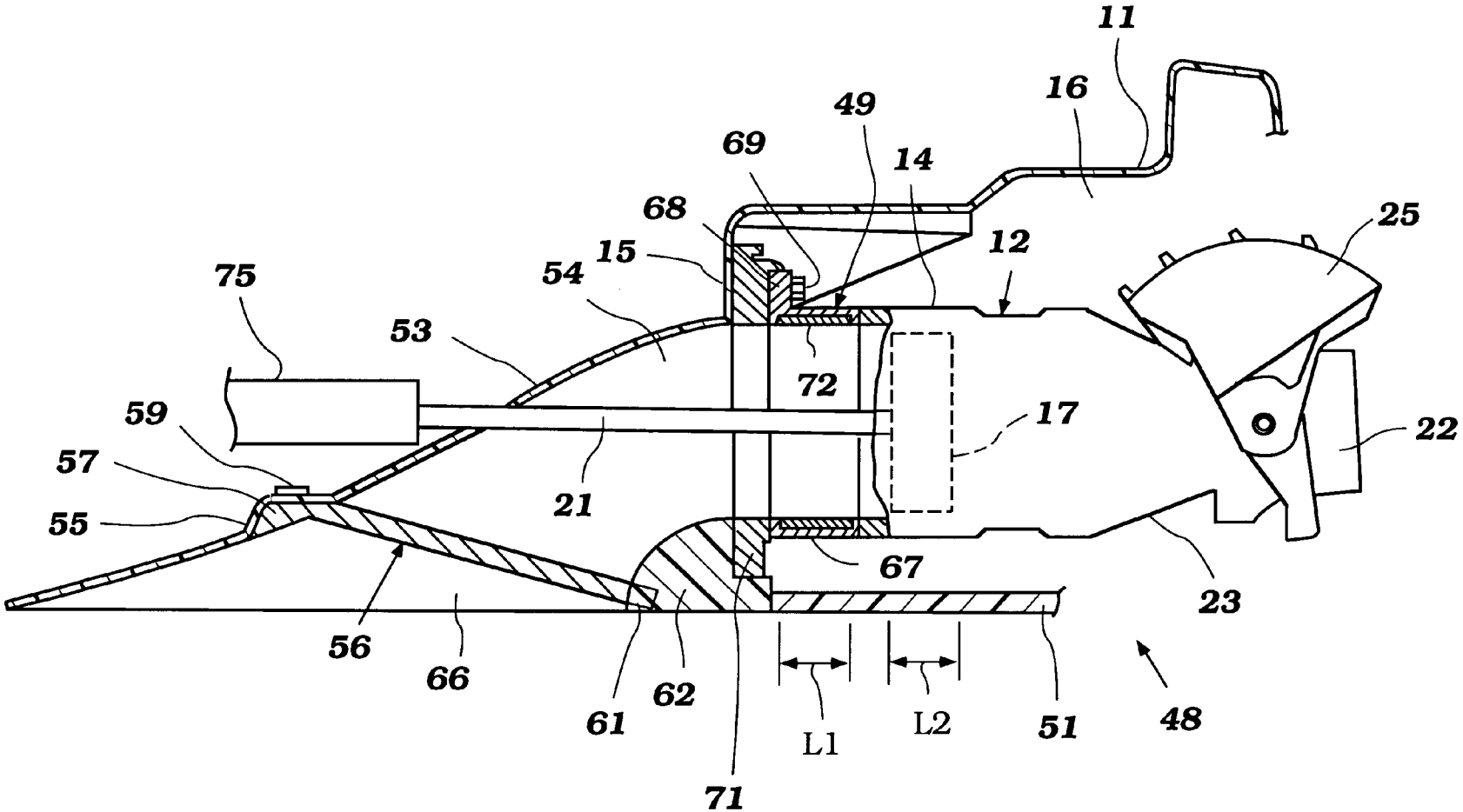
FIG. 3 is an enlarged broken away view, in part similar to FIG. 1, but showing the construction of the embodiment of invention shown in FIG. 2.
Figure 5:
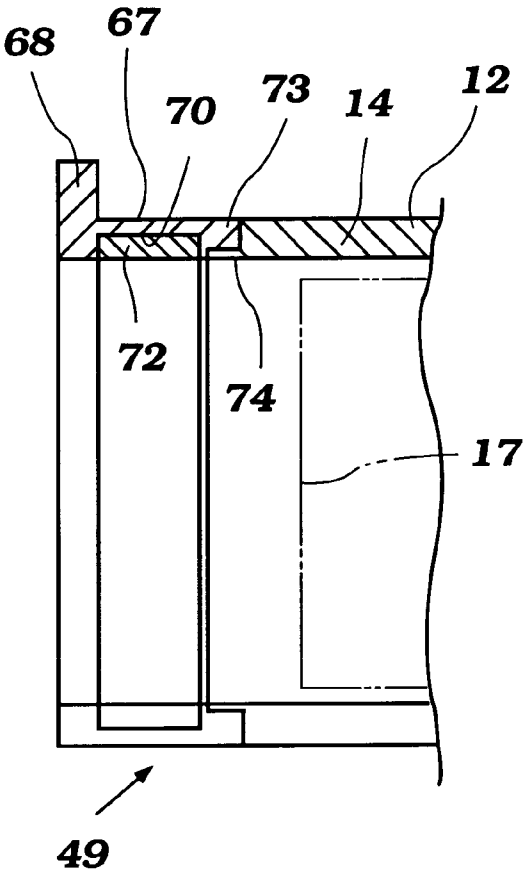
FIG. 5 is a cross sectional view taken along the line 5—5 of FIG. 4.
Figure 4:
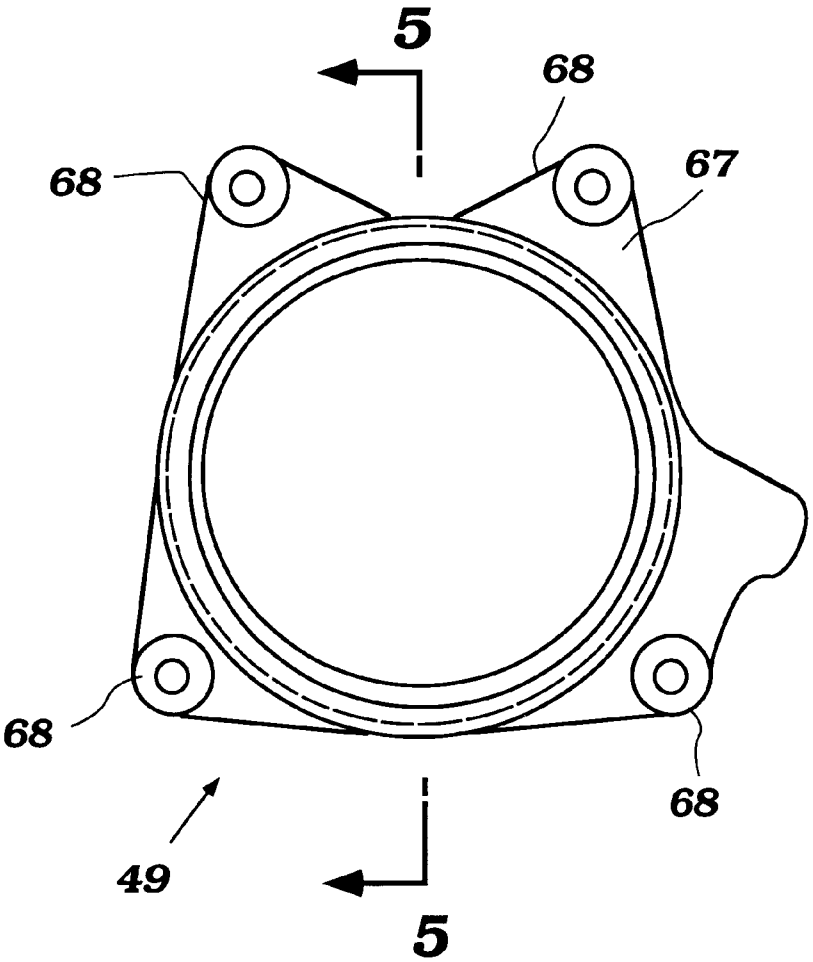
FIG. 4 is an enlarged front elevational view showing the front or inlet face of the extension portion of the jet propulsion unit in accordance with the invention.

It will be seen from FIG. 3 that forwardly of the bulkhead 15 the hull undersurface 42 has a generally curved configuration 53 that defines a water inlet passage 54 that curves upwardly and which registers with the silencing extension device 49 in manner to be described. However, the surface 53 is formed with an indentation 55 which cooperates with a grill assembly 56 that has a plurality of spaced grilled bars and mounting portion 57 at its forward end. Threaded fasteners 58 connect this portion of the grill assembly 56 to a reinforcement plate 59 formed on the inner surface of the hull portion 53.

The rear end of the grill plate 56 is received in a recess 61 of an additional mounting plate 62 that is affixed to the hull portion 42 by threaded fasteners 63 and further fasteners 64 that are connected to an extension piece of the mounting plate that defines a cavity. It will be seen from FIG. 3 that this then provides a fairly wide and elongated inlet opening 66 for the water inlet duct 54.

Referring now to the construction of the silencing extension assembly 49, which forms a first principal feature of the invention, it includes a mounting flange portion, indicated generally by the reference numeral 67. This flange portion 67 has lugs 68 that receive threaded fasteners 69 for securing the mounting bracket to a further mounting plate 71 that is fixed in a recess defined by the bulkhead 15 and the mounting plate 62.

This flange portion 67 further forms an annual groove 70 in which an elastic sleeve 72 is positioned. Rearwardly of this, the flange portion 67 has a recess 73 that receives an extension of the impeller housing 14. This extension is indicated by the reference numeral 74. This construction provides a continuous water flow path through the silencing extension device 49. Thus, the forward edge of the impeller 17 is spaced rearwardly a considerable distance from even the mounting plate 71, this distance being show by the dimension L1 in FIG. 3. This distance is substantially greater than the axial length L2 of the impeller 17 and that has been found to be significant in providing the desired degree of damping from the pulsations. In addition, the elastomeric element 72 also provides a further damping of the sound waves.

FIG. 3 shows how the impeller shaft 21 extends forwardly through the water inlet opening for its coupling to the output shaft of the engine 47 through a surrounding protective sleeve 75.

Figure 7:
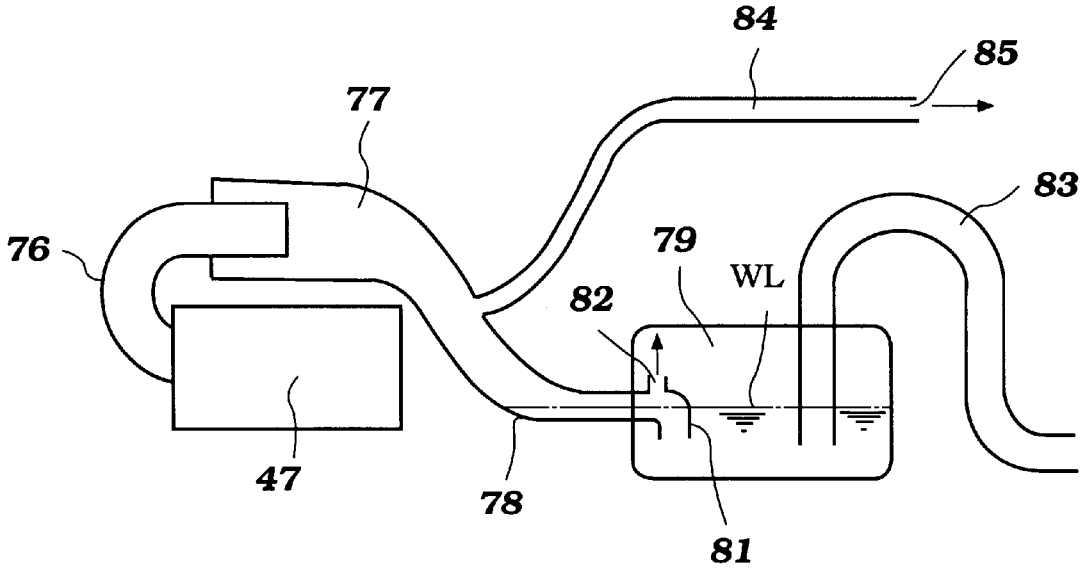
FIG. 7 is a partially schematic view including a portion showing the water trap in cross section and illustrating another feature of the invention.

The exhaust system associated with the watercraft 41 will now be described by particular reference to FIG. 7. Again, the engine 47 is shown only schematically and it has an exhaust system that includes an exhaust manifold, indicated generally by the reference numeral 76 that discharges into an expansion chamber device 77. The engine 47 is water cooled by water which is taken from the body of water in which the watercraft 41 is operating in a known manner. The exhaust manifold discharge may also include some system for delivering some or all of the cooling water from the engine 47, into the expansion chamber device 47.

An exhaust pipe 78, which may form an extension of the expansion chamber device 77, delivers the exhaust gases and water to a water trap device 79 that is positioned preferably at the rear of the hull of the watercraft 41, for example on one side of the jet propulsion unit 48. Water will accumulate a level indicated by the line WL in this figure and this during some running conditions is below the discharge end 81 of the exhaust pipe 78. Therefore, an anti-siphon opening 82 is provided and the exhaust gases can flow into the chamber of the watercraft device 79 for discharge through an exhaust outlet pipe 83.

It should be noted that the end 81 and the inlet end of the exhaust pipe 83 can be below the water level in the water trap device 79. This condition is most likely to occur during idling operation. Therefore, there is provided an idle exhaust gas discharge pipe 84 which communicates with the expansion chamber device 77 at a point above its lower edge so that water is not likely to flow into it and which discharges to the atmosphere through an opening 85 that is disposed above the water level in which the watercraft is operating under the idle operating condition. Thus, the engine idle speed can be kept lower and there will nevertheless be good silencing because of the small diameter of the idle discharge conduit 84.

Thus, from the foregoing description is should be readily apparent that the features of the invention provide a very effective silencing for both the jet propulsion unit and an exhaust system of an internal combustion engine for powering a watercraft that are particularly adept for use in personal watercraft. It is to be understood, however, that the foregoing description is that of preferred embodiments of the invention and various changes and modifications may be made without departing from the spirit and scope of the invention, as defined by the appended claims.

What is claimed is:

1. A jet propulsion system for a watercraft comprising an outer housing having an impeller portion, an impeller rotatably journalled in said impeller portion, a discharge nozzle portion positioned rearwardly of said impeller though which the water pumped by said impeller is discharged for propelling the associated watercraft, a water inlet assembly having a downwardly facing water inlet opening through which water may be drawn and a curved discharged path that curves upwardly from said water inlet opening toward the axis of rotation of said impeller, and a silencing portion interposed between said water inlet assembly and said impeller housing portion and having a shape that constitutes generally an extension of the opening of an inlet to said impeller housing portion so as to isolate the pulsations generated by said impeller from said water inlet assembly, said silencing portion including an elastomeric sleeve for further damping water pulsations caused by said impeller.

2. A jet propulsion system as set forth in claim 1 wherein the axial length of the silencing portion is greater than the axial length of the impeller.

3. A jet propulsion system as set forth in claim 1 wherein the water inlet portion is formed at least in part by the hull of the associated watercraft.

4. A jet propulsion system as set forth in claim 3 wherein the watercraft hull further forms a bulkhead between an engine compartment and a tunnel in which the jet propulsion unit out housing is contained.

5. A jet propulsion system as set forth in claim 4 wherein the jet propulsion unit outer housing is supported from the bulkhead by the silencing portion.

6. A jet propulsion system as set forth in claim 5 wherein the jet propulsion unit outer housing is detachably connected to the silencing portion.

7. A jet propulsion system as set forth in claim 5 wherein the axial length of the silencing portion is greater than the axial length of the impeller.

8. A watercraft including a jet propulsion system as set forth in claim 4 wherein an engine is supported in the engine compartment and drives the impeller through an impeller shaft that passes through the water inlet and silencing portions.

9. A watercraft as set forth in claim 8 further including an exhaust system for discharging exhaust gasses from the engine to the atmosphere including a water trap device, said exhaust system including an exhaust conduit for conveying exhaust gases from said engine to an inlet to said water trap device, an exhaust discharge for discharging the exhaust gases from said water trap device, at least one of said inlet and discharge portions of said water trap device being at least partially submerged in engine cooling water that is discharged into said engine exhaust system, said submersion existing under at least some running conditions of said watercraft, and a restricted exhaust discharge conduit that extends from the exhaust system upstream of said water trap device and discharging directly to the atmosphere independently of said water trap device.

10. A watercraft as set forth in claim 9 wherein the water trap device is positioned in the hull on one side of the jet propulsion unit.

11. A watercraft as set forth in claim 10 wherein the inlet portion to the water trap device faces downwardly and further comprising a siphon break in said inlet portion of said water trap device.

12. A watercraft as set forth in claim 11 wherein the discharge of the water trap device also faces downwardly in said water trap device.

13. A watercraft comprising a hull, an engine within said hull, a propulsion unit for said hull powered by said engine, an exhaust system for discharging exhaust gasses from said engine to the atmosphere including a water trap device, said exhaust system including an exhaust conduit for conveying exhaust gases from said engine to an inlet to said water trap device, an exhaust discharge for discharging the exhaust gases from said water trap device, at least one of said inlet and discharge portions of said water trap device being at least partially submerged in engine cooling water that is discharged into said engine exhaust system, said submersion existing under at least some running conditions of said watercraft, and a restricted exhaust discharge conduit that extends from the exhaust system upstream of said water trap device and discharging directly to the atmosphere independently of said water trap device.

14. A watercraft as set forth in claim 13 wherein the propulsion unit comprises a jet propulsion unit and the water trap device is positioned in the hull on one side of said jet propulsion unit.

15. A watercraft as set forth in claim 14 wherein the inlet portion to the water trap device faces downwardly and further comprising a siphon break in said inlet portion of said water trap device.

16. A watercraft as set forth in claim 15 wherein the discharge of the water trap device also faces downwardly in said water trap device.

* * * * *